United States Patent [19]

Bains et al.

[11] Patent Number: 4,522,357

[45] Date of Patent: Jun. 11, 1985

[54] RAM AIR STEERING SYSTEM FOR A GUIDED MISSILE

[75] Inventors: William R. Bains, Lake Elsinore; Calhoun W. Sumrall, Irvine, both of Calif.

[73] Assignee: Ford Aerospace & Communications Corp., Dearborn, Mich.

[21] Appl. No.: 489,662

[22] Filed: Jan. 19, 1983

[30] Foreign Application Priority Data

Jan. 19, 1983 [WO] PCT Int'l Appl. ..... PCT/US83/00082

[51] Int. Cl.[3] ..... F41G 7/00; B64C 21/08

[52] U.S. Cl. ..... 244/3.22; 244/52

[58] Field of Search ..... 244/52, 3.21, 3.22; 102/503

[56] References Cited

U.S. PATENT DOCUMENTS

| | | | |
|---|---|---|---|
| 2,402,718 | 6/1946 | Albree | 102/50 |
| 3,139,725 | 7/1964 | Webb | 60/35.54 |
| 3,208,383 | 9/1965 | Larson | 102/49 |
| 3,210,937 | 10/1965 | Perry, Jr. | 60/35.55 |
| 3,325,121 | 6/1967 | Banaszak et al. | 244/3.22 |
| 3,502,285 | 3/1970 | Gambill | 244/3.22 |
| 3,523,662 | 8/1970 | Rawcliffe | 244/52 |
| 3,749,334 | 7/1973 | McCorkle, Jr. | 244/3.22 |
| 3,977,629 | 8/1976 | Tubeuf | 244/3.22 |
| 4,186,899 | 2/1980 | Stewart, Jr. | 244/3.13 |
| 4,211,378 | 7/1980 | Crepin | 244/3.22 |
| 4,328,938 | 5/1982 | Reisman et al. | 244/3.1 |

FOREIGN PATENT DOCUMENTS

| | | | |
|---|---|---|---|
| 1426963 | 12/1965 | France | 244/3.22 |

*Primary Examiner*—Trygve M. Blix
*Assistant Examiner*—Rodney Corl
*Attorney, Agent, or Firm*—Paul K. Godwin, Jr.; Robert D. Sanborn

[57] ABSTRACT

An opening in the nose of a missile allows entry of ram air during missile flight to a central chamber. Oppositely oriented steering jets are interconnected with the aft end of the central chamber and escaping ram air provides lateral steering thrust forces. A movable diverting means controls the direction that the escaping ram air is diverted and thereby controls the steering forces.

3 Claims, 2 Drawing Figures

RAM AIR STEERING SYSTEM FOR A GUIDED MISSILE

TECHNICAL FIELD

The present invention is directed to the field of missile control systems and more specifically to the area of projectile steering through the use of lateral thrust control of ram air.

BACKGROUND ART

Prior art techniques for providing steering control of projectiles and self-propelled missiles often employ nose mounted controllable fins, or side mounted thrust ports connected through adjustable control valves to self-contained sources of highly-pressurized gases. Conventionally, such sources are either common to the fuel source that propels the missile or, in the case of fired projectiles, are separately ignited by an auxiliary device and dedicated to the steering function. Examples of the common fuel source missile steering techniques are shown in U.S. Pat. No. 3,139,725 and U.S. Pat. No. 3,210,937. An example of a separate fuel source for lateral steering is shown in U.S. Pat. No. 3,749,334.

DISCLOSURE OF THE INVENTION

The present invention is embodied for use in the forward portion of a projectile type missile to provide controlled lateral thrust steering in an atmospheric environment.

Lateral steering control is an important feature in projectile guidance systems. In such systems, each projectile is fired from a gun towards a target and is guided to the target via an informational beam of energy radiated from a source, usually at the firing location. The informational beam contains relative location codes by which the projectile, upon receipt of a particular code, will compute appropriate steering commands to correct its flight path. An example of a guidance system utilizing an informational beam is illustrated in commonly-assigned U.S. Pat. No. 4,186,899.

The present invention utilizes ram air that enters a central chamber in the nose of the missile and is selectively diverted to one or more laterally positioned steering jets. The diverting means, in this instance, comprises a partially cylindrical element that contains a diverting surface contoured to direct the incoming ram air to one or the other of two oppositely disposed jets. The diverting means is mounted for rotation about its cylindrical axis and is rotatably controlled by electrical signals derived from an associated on-board signal receiver and logic/processor circuit. Although the receiver and circuit are not shown as part of the present invention, they function to provide appropriate steering correction signals to control the orientation of the diverting means, in accordance with the relative location information in the informational beam and vertical reference information derived from an on-board roll reference sensor. A roll reference sensor, such as that shown in commonly-assigned U.S. Pat. No. 4,328,938, is appropriate to provide the necessary vertical reference information to the circuit.

BEST MODE FOR CARRYING OUT THE INVENTION

Figure 1:
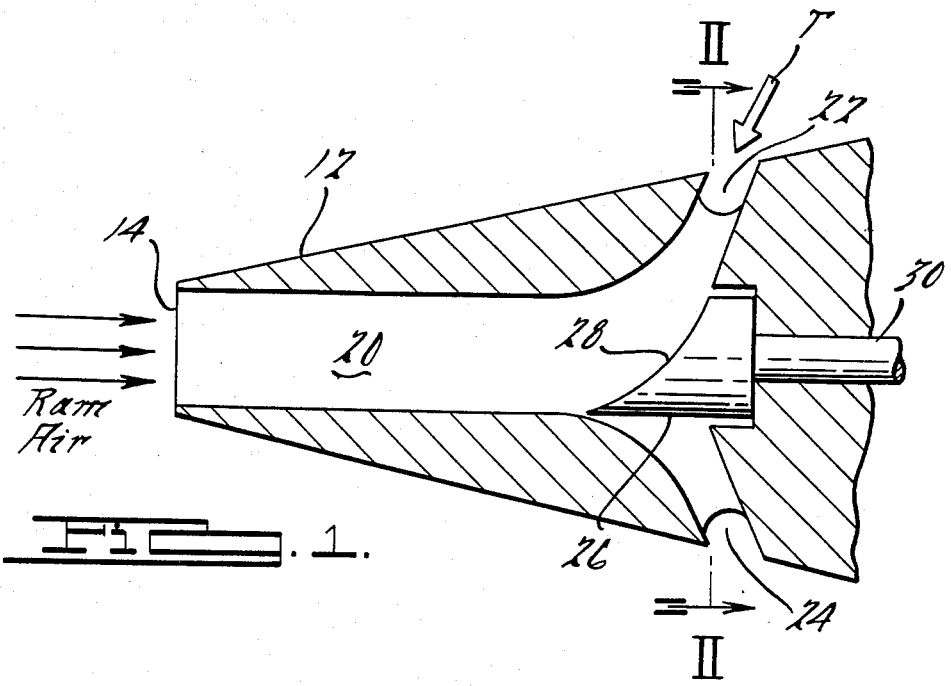
FIG. 1 is an elevational cross-section view of the forward portion of a projectile incorporating the present invention.
Figure 2:
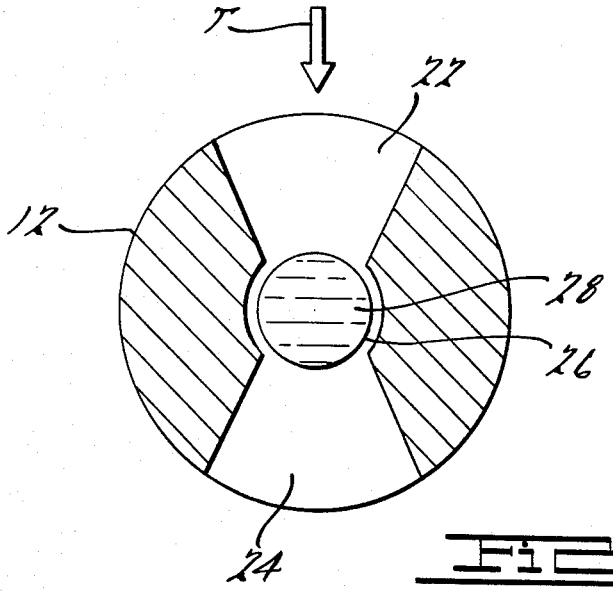
FIG. 2 is a cross-sectional view of the diverting means and steering jets shown in FIG. 1 and taken along line II—II.

The forward end of a projectile type missile 10 is shown in FIG. 1 in elevational cross-section. The forward end includes a nose member 12 that is symmetrically formed to contain the preferred embodiment. The nose member includes a ram air inlet 14 that opens to the forward end of a central cylindrical chamber 20. The aft end of the central chamber 20 is formed into separate passages that extend to diverging openings 22 and 24 in opposite sides of the nose 12 and define corresponding steering jets. The passages and openings 22 and 24 are oriented 180° apart and are slightly canted towards the rear of the missile so that escaping ram air produces thrust vectors without contributing forward motion retarding components.

A partially cylindrical diverting element 26 is mounted on a shaft 30 so as to be positioned between the central chamber 20 and the passages to the openings 22 and 24. The diverting element 26 is partially cylindrical in shape and is rotatable about its cylindrical axis, which is coaxial with the projectile axis of rotation. Contoured surface 28 is formed on the diverting element 26 and is located so as to divert ram air across the entire cross-section of the central chamber 18 to one of the openings 22 and 24. The rotatable shaft 30 is connected to the shaft of a motor (not shown) that has its speed controlled by an onboard signal receiver and logic/processor circuit (not shown).

The present invention is embodied on a projectile which is fin stabilized and has a normal in-flight roll rate of approximately 1200 rpm (20 rps) in a clockwise direction. If it is desired to have the deflector element 20 to be stationary in space so as to provide a continuous deflection of the ram air in a particular direction, such as is shown in FIG. 1, the shaft 30 will be rotated at an equal speed in the opposite direction to that of the rotating projectile. Therefore, as the projectile body rotates, the openings 22 and 24 will release the deflected ram air to provide a lateral steering thrust force vector that sinusoidally varies in amplitude over time. In order to redirect the deflector to provide a differently directed thrust force, the deflector element 26 is rotationally driven at a different speed and then returned to the 20 rps so that the steering thrust vector is redirected. In this embodiment, speed control of the motor shaft is all that is necessary to achieve accurate control of the steering thrust force vector produced by deflected ram air.

In those instances when the projectile is on a proper track and no steering forces are desired, the deflector motor is driven to rotate the deflector element 26 at a significantly faster speed than that mentioned above. For instance, if the deflector element 26 is rotated at 40 rps in a counterclockwise direction, this will have the relative effect of rotating the deflector element 26 at a speed of 20 rps, with respect to the rotating projectile, and the resulting steering thrust force vectors will effectively cancel each other to produce no resultant steering forces. The exact speed rate to be used for this purpose may be varied according to the particular projectile used.

It will be readily apparent that many modifications and variations may be implemented without departing from the scope of the novel concept of this invention. Therefore, it is intended by the appended claims to cover all such modifications and variations which fall within the true spirit and scope of the invention.

We claim:

1. A system for directionally controlling a fired projectile spinning at a predetermined rate in a predetermined direction when traveling over its flight path comprising:

means at the nose end of said projectile for defining a cylindrical chamber having one end open for receiving ram air;

a pair of oppositely disposed air passages extending from said chamber means to opposite sides of said projectile;

means between said chamber means and said passages for responsively diverting said ram air in a predetermined direction through at least one of said passages to control the steering direction of said projectile; and wherein said diverting means is rotationally driven to rotate at said predetermined rate in a direction opposite to said predetermined direction in order to maintain said diverting means in a predetermined spacial location to effect a particular steering force thrust vector.

2. A system as in claim 1, wherein said steering force thrust vector varies in amplitude at a rate which is twice the predetermined rate.

3. A ram air steering system for a guided missile comprising:

means on the forward end of said missile defining a nose portion thereof;

means within said nose means concentric with the central axis of said missile for allowing ram air to enter the interior of said nose means;

means within said nose means for diverting said entered ram air to the external environment in a lateral direction to said central axis, thereby producing lateral steering thrust forces on said missile;

said diverting means includes a pair of oppositely oriented openings positioned aft of said entering means on said nose means and respective air passages interconnecting said openings with the interior of said nose means to allow said ram air to pass therethrough;

said diverting means further includes valve means for selectively controlling the amount of air to be diverted to respective air passages; and said valve means includes a partially cylindrically shaped element mounted for relative rotation about its axis coaxial with said central axis of said missile and said element contains a first surface portion that may be selectively positioned to block one of said passages and a second surface portion that diverts the entered ram air to at least one of said passages.

* * * * *